US007549683B1

(12) United States Patent
Sikorcin

(10) Patent No.: US 7,549,683 B1
(45) Date of Patent: Jun. 23, 2009

(54) BALLOON TYING DEVICE

(76) Inventor: Wayne Sikorcin, 2662 Bentley Ct., Lisle, IL (US) 60532

( * ) Notice: Subject to any disclaimer, the term of this patent is extended or adjusted under 35 U.S.C. 154(b) by 0 days.

(21) Appl. No.: 11/852,815

(22) Filed: Sep. 10, 2007

(51) Int. Cl.
*D03J 3/00* (2006.01)

(52) U.S. Cl. ..... 289/17

(58) Field of Classification Search ..... 289/17, 289/18.1

See application file for complete search history.

(56) References Cited

U.S. PATENT DOCUMENTS 3,630,555 A * 12/1971 Newlin ..... 289/17
5,039,142 A * 8/1991 Muma ..... 289/17
5,314,217 A * 5/1994 Place ..... 289/17
5,397,326 A * 3/1995 Mangum ..... 606/148
5,611,578 A * 3/1997 Angelico, Sr. et al. ..... 289/17
6,082,785 A * 7/2000 Morgan et al. ..... 289/17
6,325,426 B1 * 12/2001 Boesl ..... 289/1.5

* cited by examiner

*Primary Examiner*—Shaun R Hurley

(57) ABSTRACT

A balloon tying device is provided. The balloon tying device includes a cylindrical shaft, a slot extending across a marginal end of the cylindrical shaft with a depth of the slot extending along a longitudinal axis of the shaft by a distance at least equal to a diameter of the shaft, a bevel located on a first side of the cylindrical shaft on opposing sides of the slot and extending from a root of the slot towards the marginal end and the shaft having a tapered end, but only on a side of the shaft opposite the bevel, with the taper starting near the root of the slot and ending with a maximum taper on the marginal end and where the taper divided by the slot.

19 Claims, 3 Drawing Sheets

BALLOON TYING DEVICE

FIELD OF THE INVENTION

The field of the invention relates to balloons and more particularly to a method of tying balloons.

BACKGROUND OF THE INVENTION

The use of balloons at weddings and parties is well known. In such cases, balloons are often used as decorations or centerpieces. Sometimes, balloons may be used to line windows or the walls of homes or reception halls. Usually the balloons are brightly colored to add a sense of festival to the occasion.

Balloons can also be used for advertising. In this case, messages, trademarks or logos may be imprinted on an outer surface of the balloon to promote a product or simply enhance brand awareness. When used for advertising, the balloons may be given away at festivals or fairs.

Balloons may be provided in any of a number of sizes. Relatively small balloons may be provided for use as decoration. Larger balloons may be used for advertising. In some cases, balloons of several feet in diameter may be imprinted with a message and filled with helium so that they float. Such balloons may be tethered to the ground over businesses to attract attention to special events.

In the case of children, balloons may be provided as a source of amusement. For younger children, balloons may be used to play games (e.g., a form of volleyball where the slow movement of the balloon is more adapted to the dexterity of the small child). Alternatively, a balloon may be filled with water for use with larger children and adults. When filled with water, such balloons may be used for water-fights on hot days.

While balloon have an almost infinite utility to both inform and amuse, they are labor intensive to use. In use, a balloon must be inflated with some fluid. In many cases, a balloon is simply inflated by a person simply pressing his/her lips to the balloon and blowing air into the balloon. Where the balloon is to be filled with helium or water, the balloon may be attached to pressure source of helium or water. Once filled, the entrance to the balloon must be closed to prevent the fluid from escaping. In many cases, the neck of the balloon is simply tied into a knot. However, the step of tying the neck of a balloon into a knot is especially difficult for a young child or even for an adult. Because of the importance of balloons, better methods are needed for tying knots in the necks of balloons.

SUMMARY OF THE INVENTION

A balloon tying device is provided. The balloon tying device includes a cylindrical shaft, a slot extending across a marginal end of the cylindrical shaft with a depth of the slot extending along a longitudinal axis of the shaft by a distance at least equal to a diameter of the shaft, a bevel located on a first side of the cylindrical shaft on opposing sides of the slot and extending from a root of the slot towards the marginal end and the shaft having a tapered end, but only on a side of the shaft opposite the bevel, with the taper starting near the root of the slot and ending with a maximum taper on the marginal end and where the taper divided by the slot.

In another aspect, the cylindrical shaft of the balloon tying device has a length of about 4 inches.

In another aspect, the diameter of the cylindrical shaft of the balloon tying device is about 0.4 inches.

In another aspect, the bevel on opposing sides of the slot provides a tapered entrance to the slot.

In another aspect, the bevel further has an angle of about fifteen degrees.

In another aspect, the slot has a depth of about 0.625 inch.

In another embodiment, the balloon tying device has a cylindrical shaft; a bevel extending along a side to a marginal end of the cylindrical shaft, a slot extending across the marginal end and dividing the bevel, said slot having a depth along a longitudinal axis of the cylindrical shaft at least equal to a diameter of the cylindrical shaft and a circular entrance having a diameter less than the diameter of the shaft extending into a sidewall of the shaft on a side opposite the bevel with a diameter of the entrance centered on the slot and extending from a root of the slot towards the marginal end.

DETAILED DESCRIPTION OF AN ILLUSTRATED EMBODIMENT

Figure 1A:
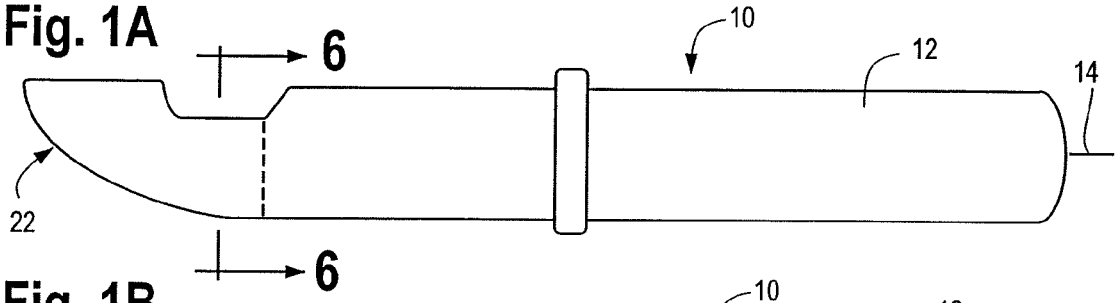
FIGS. 1A-B are side and top views of a balloon tying device in accordance with an illustrated embodiment of the invention.
Figure 1B:
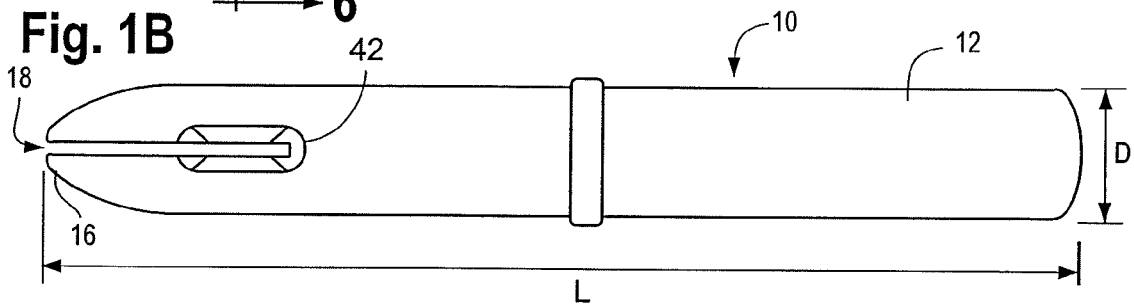

FIG. 1A-B are side and top views of a portion of a balloon tying or knotting device 10 shown generally in accordance with an illustrated embodiment of the invention. The balloon tying device 10 may be used in conjunction a set of actuators described below to automatically tie a knot in a neck of a balloon.

The tying device 10 may be constructed from a shaft 12 that is generally cylindrical in shape with any appropriate length, L, and diameter, D. Under one illustrated embodiment, the device 10 has a length of about four inches and a diameter of about 0.4 inches. Larger or smaller lengths and widths can be used depending upon the relative size of the balloon to be tied.

The device 10 has a slot 18 extending across the marginal end 16 with a depth extending into the shaft parallel to a longitudinal axis 14 of the shaft 12. The slot 18 may extend along a centerline of the shaft 12, dividing the end into equal parts, or be offset by some distance to one side of the centerline or the other. The slot 18 extends inwardly from a marginal end 16 of the shaft 12 with a depth at least equal to or larger than the diameter. In the example of FIGS. 1A-B, the depth is about 0.625 inches.

The shaft 12 may have a bevel 20 formed on opposing sides of the slot extending along the slot 18 on an outside of the shaft 12 from a root 42 of the slot 18 towards the marginal end 16, but only for a portion of the way from the root to the terminal marginal end 16. As shown in FIG. 1B, the bevel 20 extends for only about one-half of the way from the root 42 to the marginal end 16 or about 0.312 inches. The bevel 20 connects the inside walls of the slot 18 and the outside, peripheral sidewall of the shaft 12.

Figure 6:
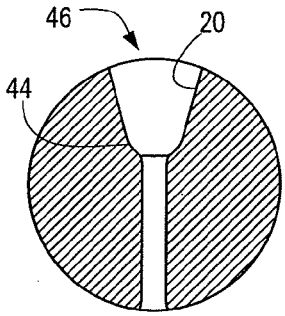
FIG. 6 depicts a cut-away end view of the balloon tying device of FIG. 1.
Figure 7:
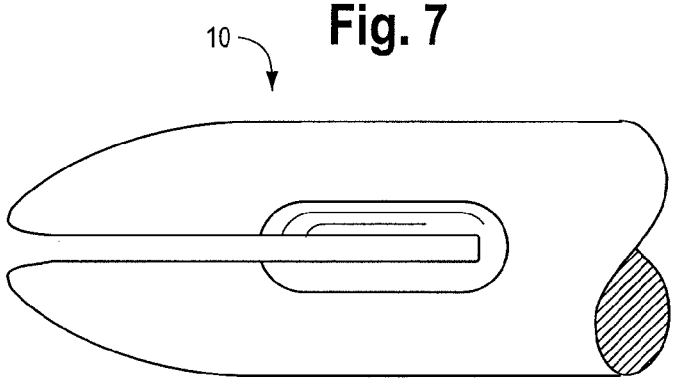
FIG. 7 depicts a partial top view of the balloon tying device of FIG. 1.

FIG. 6 is a cut-away end view of the device 10. As may be seen from FIG. 6, the bevel provides a beveled or tapered entrance 46 to the slot 18 with an entrance that extends downwards at approximately a 15 degree angle with respect to an inside wall of the slot 18. A recurve 44 at the bottom of the bevel 20 allows the tapered entrance to be relatively wide to accept the rolled end 36 of the balloon 24.

The recurve 44 is formed by first using a 0.187 inch diameter ball end mill. The ball end mill is advanced perpendicular to the longitudinal axis 14 into the shaft at the root of the slot 18 by a distance of about 0.200 inches and then moved parallel to the longitudinal axis towards the marginal end 16 by a distance of 0.312 inches. The enlarged slot formed by the ball end mill is then further enlarged with a 15 degree cutter to form the 15 degree taper. The 15 degree cutter is engaged into the sidewalls of the enlarged slot so that the tip of the cutter is tangent with the 0.093 radius of the enlarged slot.

The tapered entrance 46 is continuous with an outer periphery of the shaft. That is, there is no lip between the outer periphery of the shaft 12 and bevel 20 or between the bevel 20 and inside of the slot 18. Under the embodiment shown in FIGS. 1A-B, the entrance 46 is coincident with the centerline 14 and set back from the marginal end 16 by a distance of 0.312 inches.

The tapered entrance 46 is centered over the root end of the slot 18 to distribute the force on the neck of the balloon. That is, the beveled entrance 46 only engages the rolled end of the balloon. The beveled entrance 46 does not provide any sharp edges that could perforate or otherwise tear the neck of the balloon.

The marginal end 16 is also provided with a tapered or beveled end 22. The taper 22 is located predominantly on one side of the shaft 12 and on a side of the shaft 12 that is directly opposite the beveled entrance 46.

The taper 22 may begin with a minimum taper at a location adjacent the root 42 and increase to a maximum taper on the marginal end 16. The taper may be defined by a flattened area or the taper may have the shape of a portion of a truncated cone.

Alternatively, the taper may have a two dimensional shape as shown in FIGS. 1A-B. As shown, the taper 22 along the longitudinal axis has a curve of 0.800 inches. The taper 22 may extend around the periphery of the shaft 12 and start with a radius of 0.20 inches at the root 42 and decrease to a radius of 0.06 at the marginal end 16.

Turning now to use, an explanation will now be provided as to how the tool 10 may be used with one or more external actuators to form a knot in the neck of the balloon. To use the tying tool 10, a neck 26 of a balloon 24 that has been previously filled with a fluid may be draped 28 over a middle portion of the tying tool 10 as shown in FIG. 2A thereby forming a loop 27 between opposing end of the neck 26.

Figure 2B:
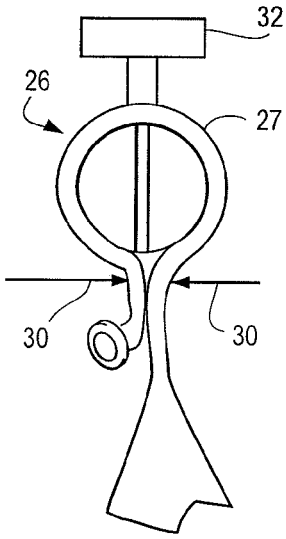
FIGS. 2A-B are side and end views showing a first step of tying a balloon.
Figure 2A:
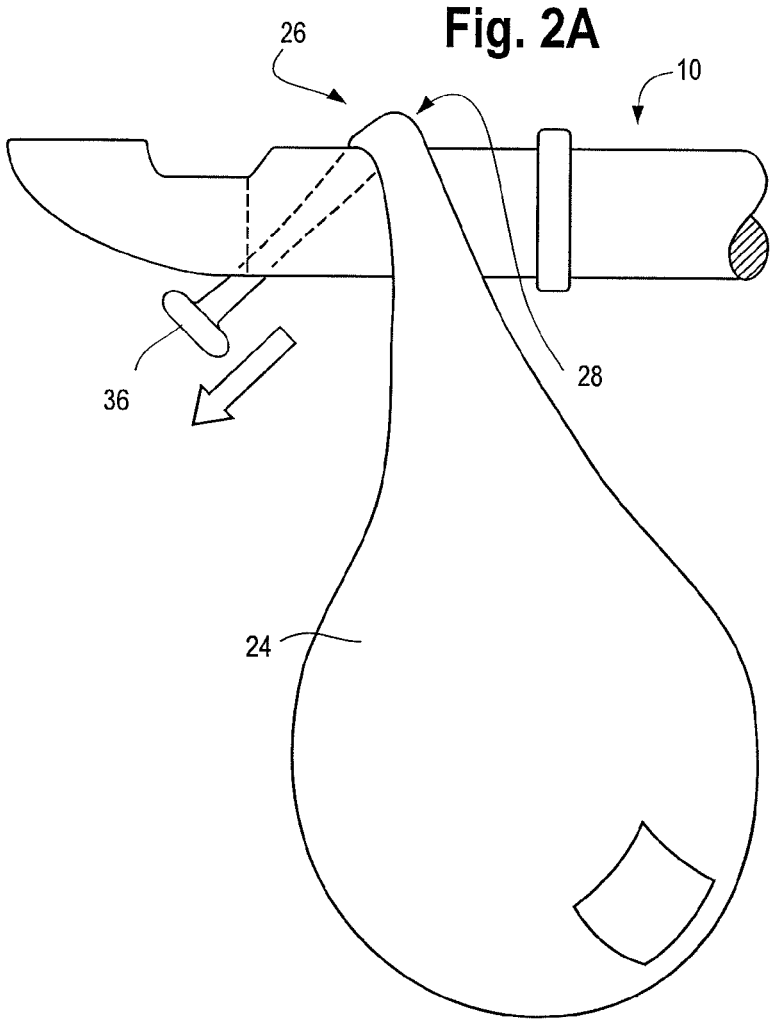

Once draped over the tool 10, opposing ends of the neck 26 may be clamped together using the actuator (e.g., a clamp) 30 shown in FIG. 2B. Alternatively, the opposing ends of the neck 26 may be clamped together between the thumb and forefinger on a first hand of a user of the tool 10.

Figure 3:
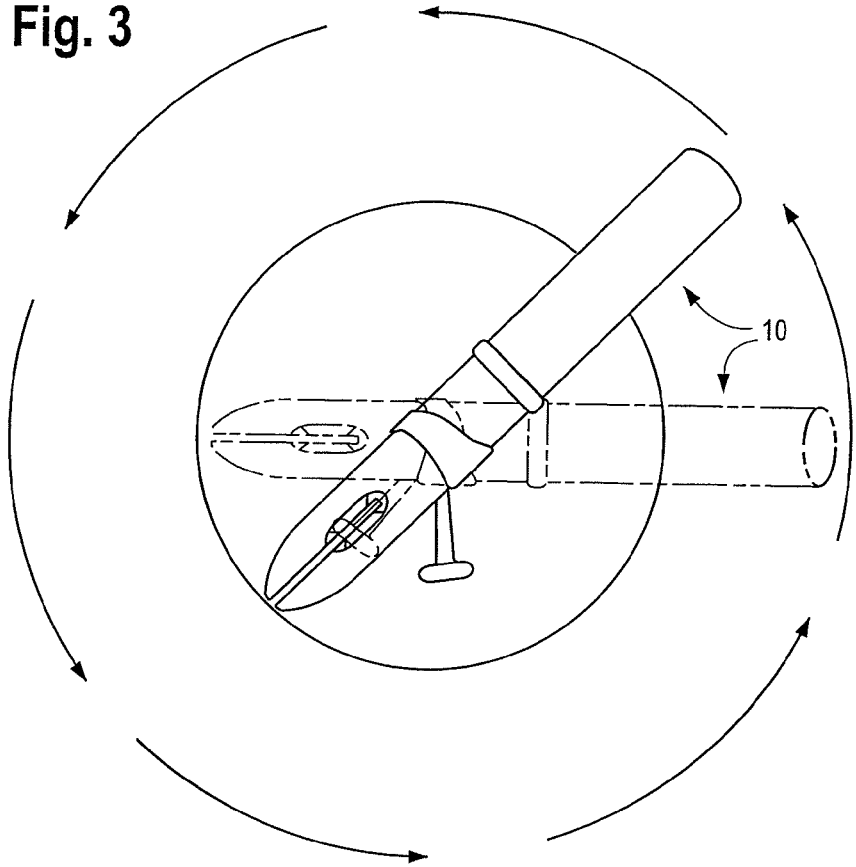
FIG. 3 depicts a second step in tying the balloon of FIGS. 2A-B.

Once the opposing ends of the neck 26 have been clamped together using either the actuator 30 or thumb and forefinger of the user, the tool 10 may be rotated relative to the clamp end of the neck 26 through one full revolution as shown in FIG. 3. The rotation of the tool 10 may be accomplished via a rotational actuator 32 or by the user grasping the center of the tool 10 in his/her second hand between the thumb and forefinger and rotating the tool 10. The rotation of the tool 10 functions to intertwine opposing ends of the neck 26.

Figure 4:
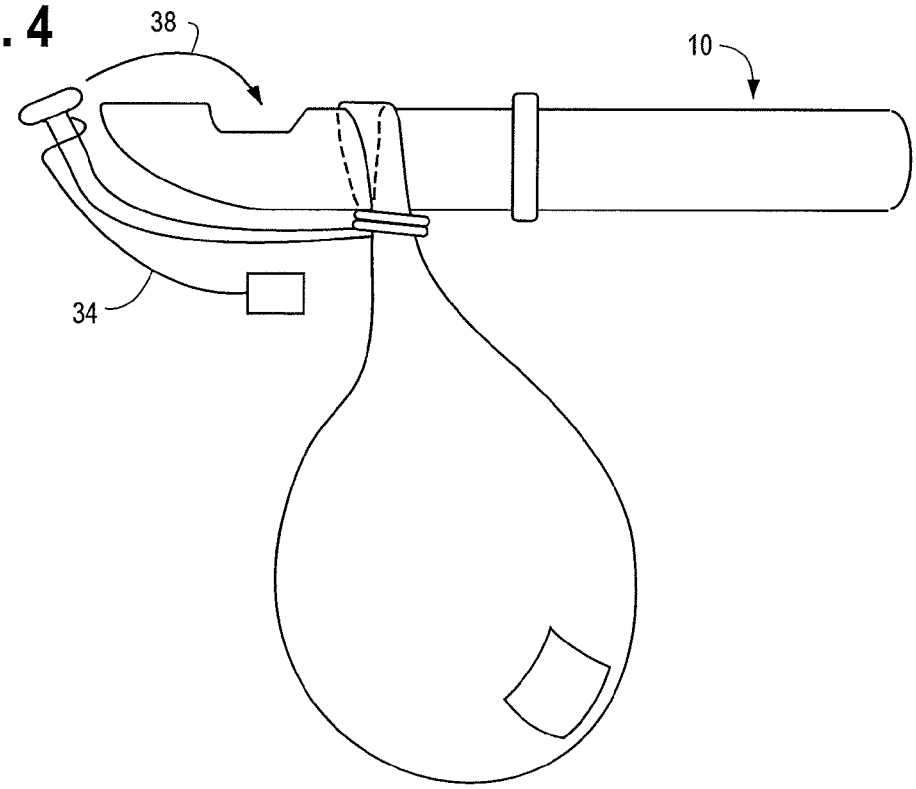
FIG. 4 depicts a third step in tying the balloon of FIGS. 2A-B.

Once the opposing ends of the neck 26 have been intertwined, a third rotary actuator 34 may engage the rolled end 36 of the balloon 24 and pull 38 the end upwards through the slot 18 as shown in FIG. 4 depositing the rolled end 36 into the entrance 20. Alternatively, the user may grasp the rolled end 36 between his/her thumb and forefinger of his/her second hand, pull the end 36 upwards through the slot 18 and release the end 36 into the beveled entrance 46.

Figure 5:
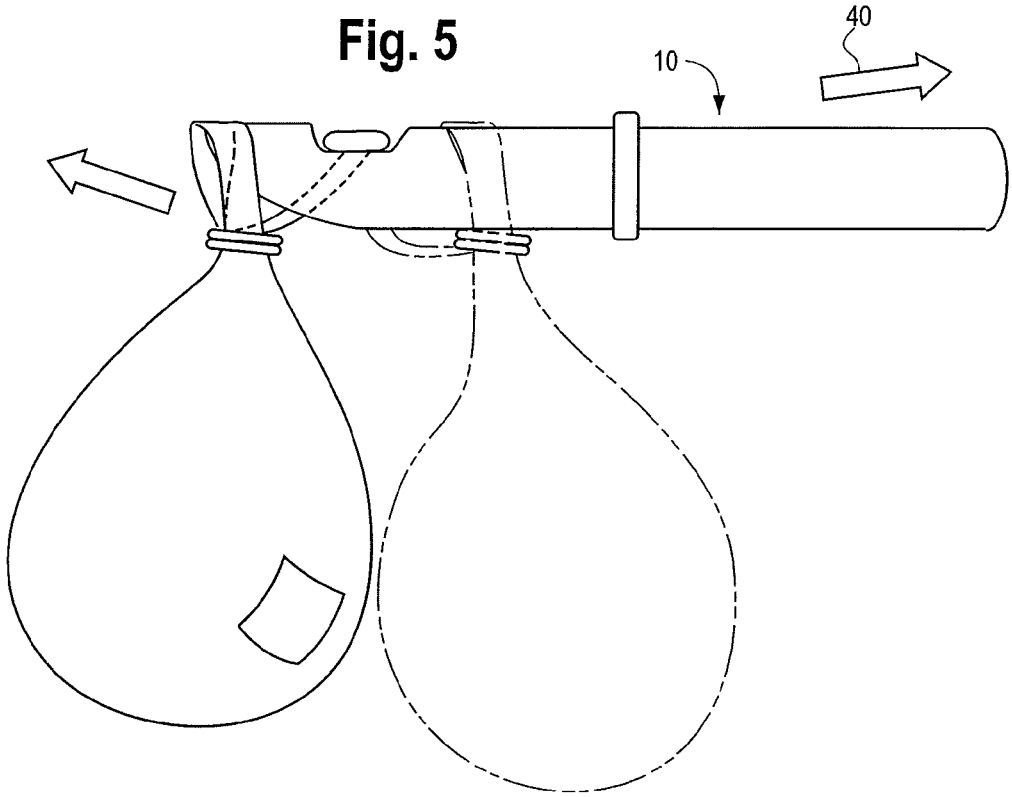
FIG. 5 depicts a final step in tying the balloon of FIGS. 2A-B.

As a final step, a fourth, linear actuator 40 may engage the balloon 24 and pull the balloon 24 away from and off the tool 10. As the balloon 24 is pulled away from the slotted end of the tool 10 as shown in FIG. 5, the entwined portions of the neck 26 are pulled along the tapered portion 22. As the loop 27 is pulled along the tapered portion 22, the decreasing diameter of the shaft 12 along the taper 22 reduces the tension in the loop 27 thereby allowing the loop 27 to be pulled over the beveled entrance 46 without dislodging the rolled end 36 from the beveled entrance 46. As the loop 27 is pulled along the taper 22, the rolled end 36 is pulled through the loop 27 thereby forming a knot in the neck 26. Once the loop 27 disengages the marginal end 16, the knot springs upwards past the centerline 14 allowing the rolled end 36 to disengage from the entrance 20.

The tool 10 provides a simple device for forming a knot in the neck of a balloon using the method steps described above. Using the tool 10, knots may be formed manually by a user without the further use of tools. Alternatively, the tool 10 may be used as part of an automatic knot tying device that includes the tool 10 and actuators 30, 32, 34, 40.

The tool 10 differs from prior art devices in a number of different ways. For example one prior art device has a flat plate-like structure with a pair of slots extending into one end of the flat plate-like structure between the flattened sides of the device. One of the slots has a taper of 10 degrees or less. The description of the flat plate-like device states that the taper has to be less than 10 degrees to prevent the knot from sliding off the device. In contrast, the tool 10 has a tapered end with a taper that is considerably larger than 10 degrees and, therefore, allows knotted balloons to be pulled from the tool 10 using much less force.

Moreover, the flat plate-like device is much more difficult to use than the tool 10. For example, to use the plate-like device, the user inserts the neck of the balloon adjacent the body of the balloon into the tapering slot, pulls the open end of the neck extending through the other side of the device away from the tapering slot and wraps the open end first around the end of the tool and then around the neck of the balloon between the device and body of the balloon. The user then inserts the rolled end of the neck into a entrance on one side of the non-tapering slot of the plate-like device and pulls the knot off the device. The difficulty with this process, however, is twofold. First, the neck must first be stretched a considerable degree to wrap the neck around the device thereby increasing the incidence of balloon perforation. Second, when the stretched end of the neck is wrapped around the balloon where the neck meets the body of the balloon, the balloon tends to pivot in response to the wrapping step thereby making it difficult to wrap the stretched neck around the balloon. In effect, the movement of the body of the balloon in response to the wrapping step requires a user to have three hands to use the plate-like tying device: one hand to hold the device, one hand to hold the stretched neck of the balloon and one hand to hold the balloon while the stretched neck is wrapped around the balloon. In contrast, the tool 10 in any of its modes of use can be easily used with two hands.

Moreover, the entrance of the plate-like device is made up of vertical side walls and a flat bottom. In contrast, the entrance 20 of the tool 10 has a tapered shape that causes the rolled end to wedge into the entrance during tying, thereby ensuring a better grip on the rolled end and a better likelihood of tying a better knot.

Another prior art device provides a slot on an end of a shaft but then uses a circular hole with a flat bottom extending into the shaft at the root of the slot to retain the rolled end of the balloon. The flat bottom of the circular hole presents a sharp edge where the slot intersects with the hole that tends to tear the neck of the balloon. In addition, the device fails to recognize the advantage of a tapered end on both sides of the slot leading to the need to impose excessive force on the balloon to pull the knot off the device.

A specific embodiment of method and apparatus for tying a balloon has been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention and any and all modifications, variations, or equivalents that fall within the true spirit and scope of the basic underlying principles disclosed and claimed herein.

The invention claimed is:

1. A balloon tying device comprising:

a cylindrical shaft;

a slot having a relatively constant width extending across a marginal end of the cylindrical shaft with a depth of the slot extending along a longitudinal axis of the shaft by a distance at least equal to a diameter of the shaft;

a bevel located on a first side of the cylindrical shaft on opposing sides of the slot and extending from a root of the slot towards the marginal end; and the shaft having a tapered end, but only on a side of the shaft opposite the bevel, with the taper starting near the root of the slot and ending with a maximum taper on the marginal end and where the taper divided by the slot.

2. The balloon tying device as in claim 1 wherein the cylindrical shaft further comprises a length of about 4 inches.

3. The balloon tying device as in claim 1 wherein the diameter further comprises a distance of about 0.4 inches.

4. The balloon tying device as in claim 1 wherein the bevel further comprises a tapered entrance to the slot.

5. The balloon tying device as in claim 1 wherein the bevel further comprises an angle of approximately fifteen degrees with respect to the slot.

6. The balloon tying device as in claim 1 wherein the slot further comprises a depth of about 0.62 inch.

7. A balloon tying device comprising:

a cylindrical shaft;

a bevel extending along a side to a marginal end of the cylindrical shaft;

a slot having a relatively constant width extending across the marginal end and dividing the bevel, said slot having a depth along a longitudinal axis of the cylindrical shaft at least equal to a diameter of the cylindrical shaft; and a beveled entrance to the slot having a diameter less than the diameter of the shaft extending into a sidewall of the shaft on a side opposite the bevel with a diameter of the entrance centered on the slot and extending from a root of the slot towards the marginal end.

8. The balloon tying device as in claim 7 further comprising the bevel on a marginal end of the shaft extending along the cylindrical shaft by a distance at least equal to the diameter of the shaft.

9. The balloon tying device as in claim 7 wherein the cylindrical shaft further comprises a length of about 4 inches.

10. The balloon tying device as in claim 7 wherein the diameter further comprises a distance of about 0.4 inches.

11. The balloon tying device as in claim 7 wherein the beveled entrance further comprises a fifteen degree angle with respect to the slot.

12. The balloon tying device as in claim 7 wherein the beveled entrance further comprises a length along the longitudinal axis of the shaft of about 0.312 inches.

13. The balloon tying device as in claim 7 wherein the slot further comprises a depth of about 0.625 inches.

14. A method of tying a balloon by a user comprising:

looping a neck of the balloon over a cylindrical shaft;

grasping opposing ends of the neck;

twisting the cylindrical shaft through a complete revolution to intertwine the opposing ends neck of the balloon;

sliding a distal end of the neck of the balloon into a slot extending into a marginal end of the shaft so that a lip of an inflation end of the balloon rests in a beveled entrance adjacent a root of the slot; and pulling the cylindrical shaft and lip through the loop to complete a knot in the neck of the balloon.

15. The method of tying the balloon as in claim 14 wherein the cylindrical shaft further comprises a length of about 4 inches.

16. The method of tying the balloon as in claim 14 wherein a diameter of the cylindrical shaft further comprises a distance of about 0.4 inches.

17. The method of tying the balloon as in claim 14 wherein the beveled entrance further comprises a fifteen degree slope.

18. The method of tying the balloon as in claim 14 wherein the beveled entrance further comprises a depth of about 0.200 inches.

19. The method of tying the balloon as in claim 14 wherein the slot further comprises a depth of about 0.625 inch.

* * * * *